United States Patent [19]

Asakura et al.

[11] Patent Number: 4,699,534

[45] Date of Patent: Oct. 13, 1987

[54] SHEET ADVANCING DEVICE

[75] Inventors: Osamu Asakura, Tokyo; Mineo Nozaki; Yoshio Uchikata, both of Kawasaki; Masasumi Nagashima, Yokosuka, all of Japan

[73] Assignee: Canon Kabushiki Kaisha, Tokyo, Japan

[21] Appl. No.: 16,530

[22] Filed: Feb. 19, 1987

Related U.S. Application Data

[63] Continuation of Ser. No. 581,713, Feb. 21, 1984, abandoned.

[30] Foreign Application Priority Data

Mar. 4, 1983 [JP] Japan ..... 58-34396
Apr. 14, 1983 [JP] Japan ..... 58-64463

[51] Int. Cl.[4] ..... B41S 19/92

[52] U.S. Cl. ..... 400/568; 400/569; 74/625

[58] Field of Search ..... 400/568, 569; 271/264; 74/625

[56] References Cited

U.S. PATENT DOCUMENTS

| | | | |
|---|---|---|---|
| 1,027,391 | 5/1912 | Raber | 400/577 |
| 2,831,559 | 4/1958 | Riffert | 400/556.3 |
| 3,272,303 | 9/1966 | Pohl | 400/569 X |
| 3,618,738 | 11/1971 | Boyatt | 400/565 X |
| 3,820,646 | 6/1974 | Lombardi | 400/569 X |
| 3,880,016 | 4/1975 | Jamieson et al. | 74/405 |
| 3,915,281 | 10/1975 | Blomquist et al. | 400/569 |
| 3,935,938 | 2/1976 | Hodne | 400/569 X |
| 4,039,069 | 8/1977 | Kwan | 400/902 X |
| 4,195,940 | 4/1980 | Rekewitz | 400/568 |
| 4,383,778 | 5/1983 | Costa | 400/569 |
| 4,494,887 | 1/1985 | Wincent | 400/568 |

FOREIGN PATENT DOCUMENTS

| | | |
|---|---|---|
| 38216 | 10/1981 | European Pat. Off. . |
| 2758148 | 5/1979 | Fed. Rep. of Germany . |
| 8005089 | 7/1981 | Fed. Rep. of Germany . |
| 3122985 | 12/1982 | Fed. Rep. of Germany . |
| 159377 | 9/1984 | Japan . |
| 215884 | 12/1984 | Japan . |
| 18370 | 1/1985 | Japan . |
| 811015 | 3/1959 | United Kingdom . |
| 1280445 | 7/1972 | United Kingdom . |
| 1282558 | 7/1972 | United Kingdom . |
| 1489792 | 10/1977 | United Kingdom . |
| 2026949 | 2/1980 | United Kingdom . |
| 2139149 | 11/1984 | United Kingdom . |

OTHER PUBLICATIONS

IBM Technical Disclosure Bulletin, vol. 19, No. 8, "Stepping Motor Stop Control", pp. 2974–2975.

IBM Technical Disclosure Bulletin, vol. 17, No. 4, "Electromechanical Variable-Index System", pp. 959–960.

*Primary Examiner*—Edgar S. Burr
*Assistant Examiner*—Moshe I. Cohen
*Attorney, Agent, or Firm*—Fitzpatrick, Cella, Harper & Scinto

[57] ABSTRACT

There is provided a sheet advancing device including a driving source for driving a sheet advancing roller, a manual advancing member for manual drive of the sheet advancing roller, detention mechanism with a detention function for elastic detent of rotation of the sheet advancing roller at a determined position, and control means for disabling the detention function in sheet advancement with the drive source but enabling the detention function in sheet advancement with the manual advancing member.

2 Claims, 4 Drawing Figures

SHEET ADVANCING DEVICE

This application is a continuation of application Ser. No. 581,713, filed Feb. 21, 1984, now abandoned.

BACKGROUND OF THE INVENTION

1. Field of the Invention

The present invention relates to a sheet advancing device for use in a typewriter or the like, and more particularly to such device with an improved detention mechanism.

2. Description of the Prior Art

FIG. 1 shows a conventional sheet advancing device, in which a platen 1 functioning as a sheet advancing roller is provided, at an end of a shaft 2 thereof, with a manual sheet advancing knob 3.

In this example a printing sheet wraps the platen over about a half of the periphery thereof and is advanced by the rotation of the platen.

On said platen shaft 2 there is provided a pulley 4 for driving by a sheet advancing motor 5 through a pulley 6 mounted on the shaft thereof and a timing belt 7 linking said pulleys. Also on the platen shaft 2 there is provided a detention disk between the pulley 4 and the sheet advancing knob 3. The detention disk 8 is star-shaped, with plural projections and recesses along the periphery.

In the vicinity of the detention disk 8, a detention lever 9 is rotatably supported at an end thereof by a shaft 10 fixed to the body of the apparatus, and is maintained in contact with the periphery of the detention disk 8 by a roller 9*a* at the other end. A spring 11 is provided between the detention lever 9 and the body of the apparatus to bias the detention lever 9 anticlockwise as indicated by an arrow shown in FIG. 1, thus pressurizing the roller 9*a* against the detention disk 8.

In case of manual sheet advancing in the above-described mechanism, the knob 3 is manually rotated causing the projecting parts of the star-shaped detention disk 8 to pass under the detention lever 9 against the force of the spring 11 and thus advancing the sheet with clicking motions.

On the other hand, in case of automatic sheet advancing, the motor 5 has to rotate the platen 1 by pushing up the detention lever 9 and is therefore required to have a power equal to the sum of sheet advancing force and detentive force.

For achieving securer click motion in such mechanism, the spring 11 of the detention lever 9 has to be made stronger to rotate, by the spring, not only the detention disk 8 but also the sheet advancing motor 5.

However, if the spring 11 of the detention lever 9 is made stronger in this manner, the sheet advancing motor 5 has to have a stronger power for pushing up the detention lever 9 as explained before, so that there is required a larger force to rotate the motor when it is not energized.

Stated otherwise, the use of a stronger power of the motor 5 leads to a correspondingly stronger linkage with other component parts, which apply a stronger rotating power to the motor when it is not energized.

It is therefore necessary to further strengthen the spring 11 of the detention lever 9, and the power of the motor 5 has to be correspondingly increased. In this manner the use of a considerably strong motor 5 and a correspondingly large electric power for driving such motor are required for ensuring secure detentive function.

FIG. 2 shows another conventional sheet advancing device, in which a sheet advancing shaft 101 is provided with a sheet advancing roller 102 made for example of rubber.

A slidable ring 103 is rotatably fitted on the shaft 101 but is prevented from rotary motion since a pin 105 fixed on the shaft 101 engages with a recess 103*a* of the ring 103.

A spring 104 is positioned between the slidable ring 103 and the sheet advancing roller 102 to bias the slidable ring 103 in a direction away from the sheet advancing roller 102.

The slidable ring 103 is provided, on a side thereof opposite to the sheet advancing roller 102, with a ratchet 103*b*, and is further provided with an integral cylindrical part 103*c* which is slidably fitted on the shaft 101 and on which a pulley 108 is rotatably fitted.

The pulley 108 is provided, on a side thereof facing the sheet advancing roller 102, with a ratchet 109 for engaging with the aforementioned ratchet 103*b*.

The ratchets 103*b*, 109 are normally in mutually engaging position since the slidable ring 103 is biased by the spring 104.

The pulley 108 is provided, on the other side thereof, with an integral detention gear 110 having projections and recesses at a regular interval along the periphery, and a detention spring 111, which is fixed at an end to the apparatus, is fitted at the other free end with one of the recesses.

The detention spring 111 is designed to have a considerably strong pressure in order to prevent undesired displacement of the sheet.

The cylindrical part 103*c* of the slidable ring 103 is provided, at the outer end, with a knob 112, which is fitted on the outer end of the shaft 101 in axially slidable but non-rotatable manner.

A sheet advancing stepping motor 106 is provided, on the shaft thereof, with a pulley 107, which is linked with a belt 107*a* with the aforementioned pulley 108 for transmitting the rotating force.

The sheet advancing function in the above-described structure is conducted in the following manner.

In case of automatic sheet advancement, a control signal is supplied to the stepping motor 106 for causing rotation of a determined angle, which is transmitted through the belt 107*a* to the pulley 108.

Since the ratchets 103*b* and 109 are normally in the mutually engaging state, the rotation of the pulley 108 is transmitted to the slidable ring 103, whereby the shaft 101 and the sheet advancing roller 102 are rotated by the pin 105 to advance the sheet.

In case of manual advancement the knob 112 is depressed whereby the integral slidable ring 103 is pressed inward against the function of the spring 104. Thus the slidable ring 103 is moved toward the roller 102 and the ratchet 103*b* is disengaged from the ratchet 109.

If the knob 112 is rotated in this state, the sheet is advanced manually by the rotation of the roller 102 through the pin 105 but the pulley 108 remains stopped.

However, in the above-described structure in which the detention spring 111 contacts the detention gear 110 with a strong force in order to prevent displacement of the sheet, the stepping motor 106 has to be large and of a high power in order to advance the sheet against the pressure of the contact, and the power supply unit has to be accordingly large and expensive.

In addition the use of such a high-powered motor requires the use of an expensive resistant material for the detention gear 110 in order to prevent abrasion thereof.

SUMMARY OF THE INVENTION

An object of the present invention is to provide a sheet advancing device capable of secure click motion.

Another object of the present invention is to provide a sheet advancing device capable of sheet advancement with a small motor and with a reduced electric power.

Still another object of the present invention is to provide a sheet advancing device with a detention mechanism allowing the device to be compact without applying excessive load to the sheet advancing motor.

Still another object of the present invention is to provide a sheet advancing device with a detention mechanism which does not function in automatic sheet advancement with a motor but only in manual sheet advancement.

Still other objects of the present invention will become fully apparent from the following detailed description of the embodiments thereof.

DETAILED DESCRIPTION OF THE PREFERRED EMBODIMENTS

Now the present invention will be clarified in detail by embodiments thereof shown in the attached drawings.

Figure 1:
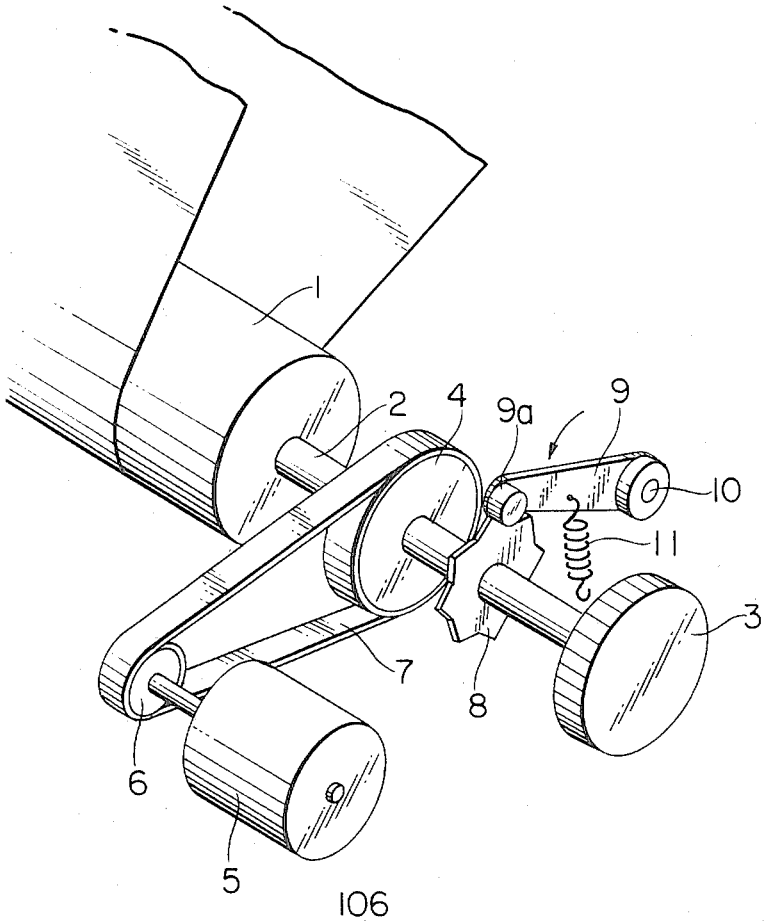
FIG. 1 PRIOR ART
FIG. 1 is a perspective view of a conventional sheet advancing device.
Figure 3:
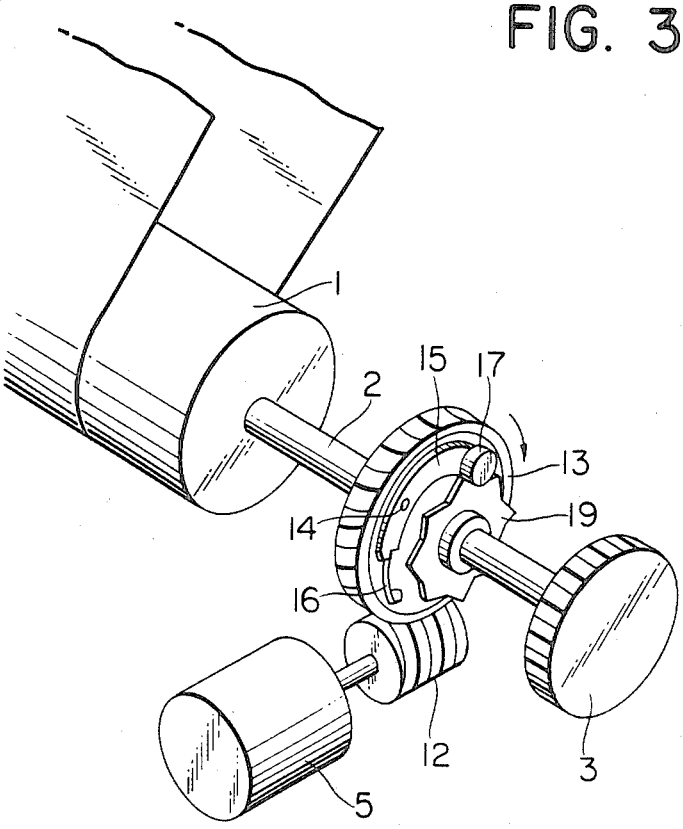
FIG. 3 is a perspective view of a first embodiment of the sheet advancing device of the present invention.

FIG. 3 shows an embodiment of the present invention, wherein the same components as those shown in FIG. 1 are represented by the same numbers and are omitted from the following description.

In the present embodiment the shaft of the sheet advancing motor 5 is provided with a worm gear 12 engaging with a worm wheel 13 rotatably supported by the platen shaft 2. On a side of the worm wheel 13 there is provided a detention lever 15 which is rotatably supported at approximate center thereof by a pin 14.

An end of the detention lever 15 is biased outward by a free end of a spring 16 fixed at the other end on the same side of the worm wheel 13, whereby a roller 17 provided at the other end of the detention lever 15 is maintained in contact with a star-shaped detention disk 19 provided on the platen shaft 2 in the vicinity of the worm wheel 13.

The detention lever 15 is constantly biased, by the spring 16, in such a manner that the roller 17 is constantly in contact with the detention disk 19.

In the automatic sheet feeding with the motor 5, the rotation thereof is transmitted through the worm gear 12 to the worm wheel 13.

In this state the worm wheel 13 rotates with the star-shaped detention disk 19, because of the pressure contact of the roller 17 of the detention lever 15 with the detention disk 19 though the worm wheel 13 is freely rotatable with respect to the platen shaft 2.

In this manner the platen shaft 2 and the platen 1 are rotated.

In such automatic sheet advancement, the detention lever 15 need not be pushed up since it rotates integrally with the worm wheel 13, so that the motor 5 can be of a small power and requires only a small electric power.

On the other hand, in case of manual sheet feeding, the manual rotation of the knob 3 causes rotation of the platen shaft 2 and the platen 1, with integral rotation of the star-shaped detention disk 19.

In such state the worm gear 12 is maintained in meshing with the worm wheel 13. As the lead angle of said worm gear 12 and worm wheel 13 is selected smaller than the limit lead angle, a rotating power applied from the worm wheel 13 does not cause rotation of the worm gear 12.

Thus the detention lever 15 is in a state as if stationarily fixed and is pushed up, when the detention disk 19 rotates with the platen shaft 2, to generate clicks in such manual sheet feeding, thereby performing the function of detention mechanism.

The use of a worm gear in this manner allows realization of a sheet advancing mechanism in which the detention mechanism does not function in the automatic sheet feeding with a motor but in the manual sheet feeding with click function.

Besides the motor can be of a lower power and requires only a limited electric power since the detention lever is not pushed up in the automatic sheet advancement.

Figure 2:
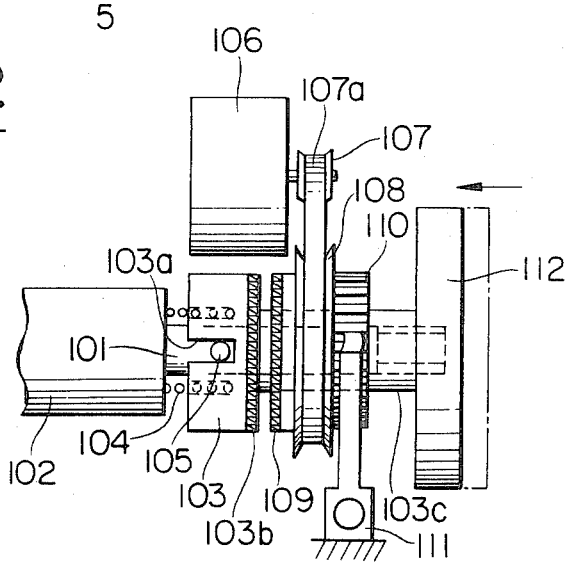
FIG. 2 PRIOR ART
FIG. 2 is a plan view showing another conventional sheet advancing device.
Figure 4:
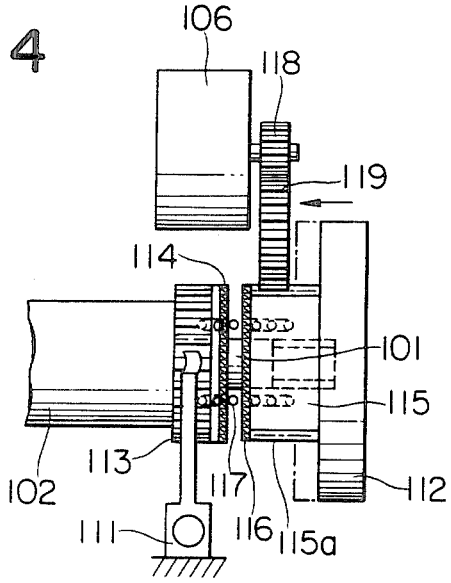
FIG. 4 is a plan view of a second embodiment of the sheet advancing device of the present invention.

FIG. 4 shows another embodiment of the present invention, wherein the same components as those in FIG. 2 are represented by the same numbers and are omitted from the following description.

In FIG. 4, a detention gear 113 is positioned in contact with a lateral end of the sheet advancing roller 102 and is rotatably supported by the shaft 101.

The detention gear 113 is provided, on an outer side thereof, with a ratchet 114 the periphery of which is maintained in contact with a free end of a detention spring 111.

The knob 112 is provided, on a side thereof, with a cylindrical part 115 extending toward the detention gear 113 and having a gear **115*a*** around the external periphery thereof.

In addition, a ratchet 116 is formed on a lateral end of the cylindrical part 115 facing the ratchet 114.

A spring 117 is provided between the knob 112 and the detention gear 113 to bias the ratchets 114, 116 apart.

As explained before, the knob 112 is fitted on the shaft 101 in axially slidable but nonrotatable manner.

The shaft of a stepping motor 106 is provided with a pinion 118 of which rotation is transmitted to the aforementioned gear **115*a* through an intermediate gear 119**.

The function of the above-described embodiment is as follows.

In case of automatic sheet advancement, the rotation of the stepping motor 106 is transmitted through the intermediate gear 119 to the gear **115*a* to rotate the knob 112, whereby the roller 102 is rotated through the shaft 101** for advancing the sheet.

In this state the detention function is disabled since the detention gear 113 is stopped, as it is freely rotatable with respect to the shaft 101 and is firmly pressed by the detention spring 111.

Consequently the sheet advancing roller 102 can be rotated even with a low-powered stepping motor 106.

On the other hand, in the manual sheet advancement, the knob 112 is pressed against the force of the spring 117 to engage the ratchet 114 with the ratchet 116.

In this state, the manual rotation of the knob 112 is transmitted to the detention gear 113, due to the meshing of the ratchets 114, 116, to achieve manual advancement with detention function.

When the knob 112 is released, it returns to the original state by the force of the spring 117.

As explained in the foregoing, the present embodiment allows realization of a simple, small and inexpensive sheet advancing device enabling the use of a low-powered motor because the motor load is drastically reduced by use of a detention mechanism which does not function in the automatic sheet advancement with motor but only in the manual sheet advancement.

What we claim is:

1. A sheet advancing device comprising:

a rotary member for advancing a sheet;

a drive source for driving said rotary member;

drive transmitting means for transmitting a drive force of said drive source to said rotary member in order to rotate said rotary member by the drive force of the drive source;

a manual operation member for manually driving said rotary member;

detent means for effecting elastic detent of rotation of said rotary member at a determined position; and control means for permitting said detent means to execute the detent function when said rotary member is driven by operation of said manual operation member, and preventing said detent means from executing the detent function when said rotary member is driven by the drive force of the drive source.

2. A device according to claim 1, wherein said control means performs drive transmitting function when said rotary member is driven by the drive force of said drive source.

* * * * *